US007213543B2

(12) United States Patent
Miyashita

(10) Patent No.: US 7,213,543 B2
(45) Date of Patent: May 8, 2007

(54) TECHNIQUE OF DETECTING FAILURE OF COMPRESSION RATIO VARYING MECHANISM AND CONTROLLING INTERNAL COMBUSTION ENGINE

(75) Inventor: Shigeki Miyashita, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 201 days.

(21) Appl. No.: 10/813,302

(22) Filed: Mar. 31, 2004

(65) Prior Publication Data

US 2004/0194737 A1 Oct. 7, 2004

(30) Foreign Application Priority Data

Apr. 4, 2003 (JP) ..... 2003-101397

(51) Int. Cl.
*F02B 75/04* (2006.01)

(52) U.S. Cl. ..... 123/48 C; 123/78 F

(58) Field of Classification Search ..... 123/480, 123/48 B, 78 F, 196 R, 48 C
See application file for complete search history.

(56) References Cited

U.S. PATENT DOCUMENTS

| | | | |
|---|---|---|---|
| 4,834,031 | A | 5/1989 | Katoh et al. |
| 6,453,854 | B1 | 9/2002 | Baeuerle et al. |
| 6,595,187 | B1 | 7/2003 | Russell |

FOREIGN PATENT DOCUMENTS

| | | |
|---|---|---|
| JP | A-52-113428 | 9/1977 |
| JP | U-62-72450 | 5/1987 |
| JP | A 64-35047 | 2/1989 |
| JP | U-1-95549 | 6/1989 |
| JP | U 1-97054 | 6/1989 |
| JP | U-1-97055 | 6/1989 |
| JP | A 6-117348 | 4/1994 |
| JP | B2 7-72515 | 8/1995 |
| JP | A-7-259665 | 10/1995 |
| JP | A-11-294194 | 10/1999 |
| JP | A-2000-145600 | 5/2000 |
| JP | A-2000-352335 | 12/2000 |
| JP | A-2001-280123 | 10/2001 |
| JP | A-2001-355494 | 12/2001 |
| JP | A-2002/285898 | 10/2002 |
| JP | A-2003-65130 | 3/2003 |

*Primary Examiner*—Stephen K. Cronin
*Assistant Examiner*—Katrina Harris
(74) *Attorney, Agent, or Firm*—Oliff & Berridge, PLC

(57) ABSTRACT

In an internal combustion engine having a compression ratio varying mechanism, in response to detection of the occurrence of any failure or trouble in the compression ratio varying mechanism, the control technique of the invention restricts execution of a specific control, which has adverse effects on stable combustion of the air-fuel mixture. The specific control having adverse effects on the stable combustion of the air-fuel mixture includes warm-up ignition delay control, lean burn control, and EGR control. This arrangement ensures table combustion of the air-fuel mixture, even when the compression ratio varying mechanism is locked in at a low compression ratio. The technique of the invention thus enables the internal combustion engine to be driven stably, even in the case of the occurrence of any failure or trouble in the compression ratio varying mechanism.

9 Claims, 7 Drawing Sheets

TECHNIQUE OF DETECTING FAILURE OF COMPRESSION RATIO VARYING MECHANISM AND CONTROLLING INTERNAL COMBUSTION ENGINE

BACKGROUND OF THE INVENTION

1. Field of the Invention

The present invention relates to a technique of varying a compression ratio in an internal combustion engine. More specifically the invention pertains to a technique of detecting a failure or trouble arising in a compression ratio varying mechanism and controlling an internal combustion engine.

2. Description of the Related Art

The internal combustion engine is advantageously small in size but is capable of outputting relatively large power. Because of these advantages, the internal combustion engine is widely used as the power source of diverse transportation facilities, such as automobiles, ships and boats, and aircraft, and as the power source of various stationary machines and equipment. The internal combustion engine makes a compressed air-fuel mixture subjected to combustion in a combustion chamber, converts the combustion pressure generated through the combustion into mechanical power, and takes out the mechanical power.

A technique of varying the compression ratio of the air-fuel mixture according to the driving conditions of the internal combustion engine has been proposed to improve a conversion efficiency into mechanical power (that is, a thermal efficiency) and increase an maximum output. Setting a low compression ratio ensures a sufficiently high maximum output under the conditions of high loading. Setting a high compression ratio enhances the thermal efficiency under the conditions of medium or low loading. The optimum ignition timing depends upon the compression ratio. The lower compression ratio advances the optimum ignition timing. The general control procedure thus changes the ignition timing with a variation in compression ratio.

One proposed technique fixes the ignition timing to the setting suitable for the high compression ratio, when any failure arises in the course of varying the compression ratio in the internal combustion engine (see Japanese Patent Laid-Open Gazette No. 1-35047). The technique of this cited reference fixes the ignition timing to the setting for the high compression ratio, when the compression ratio is locked in at the high compression ratio. The technique prevents the ignition timing from advancing to the setting suitable for the low compression ratio, in the case of a lock-in of the compression ratio, thus lowering the potential for abnormal combustion called knocking.

The above prior art technique lowers the potential for knocking but may not allow the internal combustion engine to be driven stably, when some trouble or failure arises in the course of varying the compression ratio. Even when the compression ratio is locked in at the low compression ratio, this proposed technique fixes the ignition timing to the setting suitable for the high compression ratio. Such fixation is disadvantageous to stable driving of the internal combustion engine. The low compression ratio is undesirable for quick and stable combustion of the air-fuel mixture in a combustion chamber. For stable combustion of the air-fuel mixture, the ignition timing is thus to be changed to the adequate setting with a decrease in compression ratio. Diverse controls are carried out in the internal combustion engine with the aim of improving the thermal efficiency or of reducing the emission. Some of such controls have adverse effects on stable combustion. Execution of such controls in the state of a lock-in of the low compression ratio may lower the stability of combustion and prevent the internal combustion engine from being driven stably.

SUMMARY OF THE INVENTION

The object of the invention is thus to provide a technique that enables an internal combustion engine equipped with a compression ratio varying mechanism to be driven stably, even in the case of the occurrence of any failure or trouble in the compression ratio varying mechanism.

In order to attain at least part of the above and the other related objects, the present invention is directed to an internal combustion engine that compresses an air-fuel mixture of a fuel and the air and makes the compressed air-fuel mixture subjected to combustion in a combustion chamber to generate power. The internal combustion engine includes: a compression ratio varying mechanism that varies a compression ratio as an indicator representing a degree of compression of the air-fuel mixture; a compression ratio control module that controls actuation of the compression ratio varying mechanism, so as to regulate the compression ratio according to a driving condition of the internal combustion engine; a failure detection module that detects occurrence of a failure in the compression ratio varying mechanism; and a specific control restriction module that, in response to detection of the occurrence of a failure, restricts execution of a specific control that has adverse effects on stable combustion of the air-fuel mixture.

Another application of the invention is a corresponding control method of the internal combustion engine. The invention is accordingly directed to a control method of an internal combustion engine that compresses an air-fuel mixture of a fuel and the air and makes the compressed air-fuel mixture subjected to combustion in a combustion chamber to generate power. The control method includes the steps of: controlling actuation of a compression ratio varying mechanism, which varies a compression ratio as an indicator representing a degree of compression of the air-fuel mixture, according to a driving condition of the internal combustion engine, so as to regulate the compression ratio of the internal combustion engine; detecting occurrence of a failure in the compression ratio varying mechanism; and in response to detection of the occurrence of a failure, restricting execution of a specific control that has adverse effects on stable combustion of the air-fuel mixture.

The internal combustion engine of the invention and the corresponding control method of the internal combustion engine restrict execution of the specific control having adverse effects on stable combustion of the air-fuel mixture, when any failure or trouble arises in the compression ratio varying mechanism. This arrangement ensures stable combustion of the air-fuel mixture and thereby stable driving of the internal combustion engine, even in the case of the occurrence of a failure in the compression ratio varying mechanism.

In one embodiment of the internal combustion engine, the compression ratio varying mechanism changes over the compression ratio between at least two different levels, that is, a first compression ratio of a lowest level and a second compression ratio of a highest level. In this embodiment, detection of a non-variable state of the compression ratio to at least the second compression ratio in the compression ratio varying mechanism indicates the occurrence of a failure.

The higher compression ratio enhances combustion of the air-fuel mixture. Under the condition of a high compression ratio, a control operation having adverse effects on stable combustion is often carried out by taking into account this tendency. While a failure in the compression ratio varying mechanism does not allow the compression ratio to be set to a high level, execution of this control operation heightens the potential for poor combustion. The arrangement of determining the occurrence of a failure based on detection of a non-variable state of the compression ratio to the second compression ratio effectively prevents poor combustion and advantageously ensures stable driving of the internal combustion engine.

The internal combustion engine may have a function of detecting a lock-in compression ratio, at which the compression ratio varying mechanism is locked in. In this structure, the occurrence of a failure may be determined, when the lock-in compression ratio is different from the second compression ratio.

When the lock-in compression ratio is equal to the second compression ratio, the specific control having adverse effects on stable combustion of the air-fuel mixture does not substantially interfere with the stable combustion. In such cases, the internal combustion engine is driven stably even under the specific control to enhance a thermal efficiency or to reduce emission.

In the internal combustion engine having a variable air-fuel ratio between a stoichiometric air-fuel ratio and a lean air-fuel ratio, a control operation of setting the lean air-fuel ratio may be restricted, in response to detection of the occurrence of a failure in the compression ratio varying mechanism. Restriction of the control operation of setting the lean air-fuel ratio may narrow a driving condition for setting the lean air-fuel ratio, may reduce a lean degree of the air-fuel ratio, or may be a combination thereof. The control operation of setting the lean air-fuel ratio may otherwise be prohibited.

As is known in the art, the lean air-fuel ratio of the air-fuel mixture tends to lower the stability of combustion. When any failure is detected in the compression ratio varying mechanism, restriction of the control operation of setting the lean air-fuel ratio desirably prevents unstable combustion of the air-fuel mixture.

In one embodiment, the internal combustion engine carries out an ignition delay control to retard the ignition timing, when the internal combustion engine is in a cold state. This ignition delay control may be restricted, in response to detection of the occurrence of a failure in the compression ratio varying mechanism. Restriction of the ignition delay control may narrow a driving condition for delaying the ignition timing, may reduce a degree of ignition delay, or may be a combination thereof. The ignition delay control may otherwise be prohibited.

When the internal combustion engine is in the cold state, the ignition delay control may be carried out to retard the ignition timing from the optimum ignition timing that ensures the most favorable combustion state. The delay of the ignition timing tends to lower the stability of combustion. When any failure is detected in the compression ratio varying mechanism, restriction of the ignition delay control to retard the ignition timing desirably prevents unstable combustion of the air-fuel mixture.

In another example, the internal combustion engine comprises an EGR mechanism to recirculate part of the combustion exhaust, which is produced by combustion of the air-fuel mixture, into the combustion chamber and an EGR control module that controls the amount of the recirculated combustion exhaust by operating said EGR mechanism according to the driving condition of said internal combustion engine. This recirculation by said EGR mechanism is restricted, in response to detection of the occurrence of a failure in the compression ratio varying mechanism. Restriction of the EGR control may narrow a driving condition for carrying out the EGR control, may reduce a flow of combustion exhaust (EGR gas) to be recirculated into the combustion chamber, or may be a combination thereof. The EGR control may otherwise be prohibited. One method of recirculating the combustion exhaust into the combustion chamber may lead a partial flow of the combustion exhaust, which is discharged from the combustion chamber, from an exhaust conduit back to an intake conduit. Another method may cause part of the combustion exhaust to be ejected from the combustion chamber to the intake conduit and to be taken in again with the flow of the air.

Execution of the EGR control to recirculate the combustion exhaust tends to lower the stability of combustion of the air-fuel mixture. When any failure is detected in the compression ratio varying mechanism, restriction of the EGR control desirably prevents unstable combustion of the air-fuel mixture.

In one preferable application, the internal combustion engine detects a lock-in of the compression ratio varying mechanism and restricts a control specification of the control operation having adverse effects on the stable combustion to an allowable range corresponding to each lock-in compression ratio.

In the case of detection of the occurrence of a failure in the compression ratio varying mechanism, execution of the control operation having adverse effects on the stable combustion in the allowable range desirably enables the internal combustion engine to be driven without lowering the stability of combustion.

In one preferable embodiment, the internal combustion engine has an intake conduit that leads a supply of intake air to the combustion chamber, a first fuel injection valve that injects the fuel in the intake conduit, and a second fuel injection valve that injects the fuel into the combustion chamber. At least one of the first fuel injection valve and the second fuel injection valve is actuated to inject the fuel according to the driving condition of the internal combustion engine. In this embodiment, actuation of the first fuel injection valve to inject the fuel is restricted, in response to detection of the occurrence of a failure.

While the compression ratio varying mechanism has a failure, injection of the fuel in the intake conduit may cause a phenomenon called backfire, which astonishes the driver. The backfire will be discussed in detail later. The arrangement of restricting the fuel injection from the first fuel injection valve and allowing only the second fuel injection valve to inject the fuel effectively prevents the occurrence of backfire.

These and other objects, features, aspects, and advantages of the present invention will become more apparent from the following detailed description of the preferred embodiments with the accompanying drawings.

DESCRIPTION OF THE PREFERRED EMBODIMENTS

Some modes of carrying out the invention are discussed below as preferred embodiments in the following sequence:

A. System Structure

B. First Embodiment

B-1. Control in Cold State

B-2. Control in Warm-up State

C. Second Embodiment

A. System Structure

Figure 1:
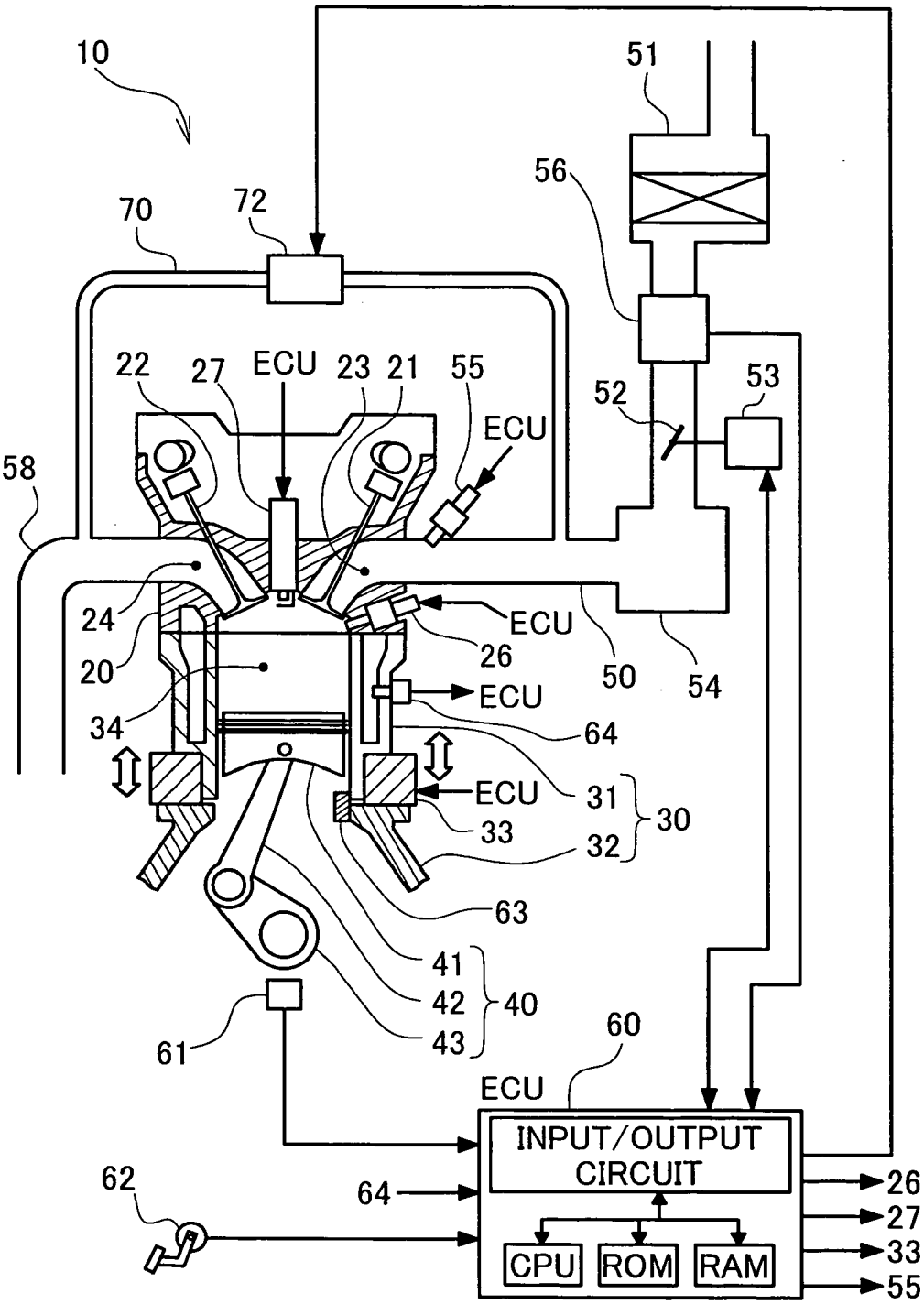
FIG. 1 schematically illustrates the structure of an engine in one embodiment of the invention.

FIG. 1 schematically illustrates the structure of an engine 10 including a compression ratio varying mechanism in one embodiment of the invention. As illustrated, the engine 10 mainly includes a cylinder head 20, a cylinder block assembly 30, a main moving assembly 40, intake conduits 50, exhaust conduits 58, EGR conduits 70, and an engine control unit (hereafter referred to as ECU) 60.

The cylinder block assembly 30 has an upper block 31 with the cylinder head 20 mounted thereon and a lower block 32 to receive the main moving assembly 40 therein. An actuator 33 is interposed between the upper block 31 and the lower block 32. The actuator 33 is driven to vertically move the upper block 31 relative to the lower block 32. Tubular cylinders 34 are formed in the upper block 31.

The main moving assembly 40 has pistons 41 received inside the cylinders 34, a crankshaft 43 rotating inside the lower block 32, and connecting rods 42 connecting the pistons 41 with the crankshaft 43. The pistons 41, the connecting rods 42, and the crankshaft 43 constitute a crank mechanism. Rotation of the crankshaft 43 slides up and down each piston 41 in the corresponding cylinder 34, while the vertical sliding motion of the piston 41 rotates the crankshaft 43 in the lower block 32.

Attachment of the cylinder head 20 to the cylinder block assembly 30 gives spaces defined by a lower face of the cylinder head 20 (a face coming into contact with the upper block 31), the cylinders 34, and the pistons 41. These spaces function as combustion chambers. The upward movement of the upper block 31 by actuation of the actuator 33 moves the cylinder head 20 up to increase the inner volume of each combustion chamber, thus lowering the compression ratio. The downward movement of the cylinder head 20 with the upper block 31, on the other hand, reduces the inner volume of each combustion chamber to heighten the compression ratio.

The compression ratio may be measured by a compression ratio sensor 63, which is located in the lower block 32. In the structure of this embodiment, a stroke sensor is applied for the compression ratio sensor 63 and measures a relative position of the upper block 31 to the lower block 32 to specify the compression ratio. The stroke sensor is not restrictive at all, but any other suitable method is applicable to detect the compression ratio. For example, a pressure sensor located in the cylinder head 20 may be used to measure the pressure in the combustion chamber and specify the compression ratio based on the observed pressure.

The cylinder head 20 has intake ports 23 to take the air into the corresponding combustion chambers and exhaust ports 24 to discharge the exhaust gas from the corresponding combustion chambers. An intake valve 21 is set at an opening of each intake port 23 to the combustion chamber, and an exhaust valve 22 is set at an opening of each exhaust port 24 to the combustion chamber. The intake valves 21 and the exhaust valves 22 are driven by a cam mechanism with the vertical motions of the pistons 41. The on-off control of the intake valves 21 and the exhaust valves 22 at respective adequate timings in synchronism with the motions of the pistons 41 takes the air into the combustion chambers and discharges the exhaust gas from the combustion chambers. The cylinder head 20 has an ignition plug 27, which ignites the air-fuel mixture with a spark in the combustion chambers.

Each intake conduit 50 is connected with the intake port 23 of the cylinder head 20 to lead the air to the cylinder head 20. An air cleaner 51 is set on an upstream end of the intake conduits 50. The engine 10 of the embodiment is a 4-cylinder engine and has four combustion chambers. The intake conduits 50 of the four combustion chambers join together at a serve tank 54. The supply of the air goes through the air cleaner 51 for removal of dust and foreign substances, is distributed by the serge tank 54 into the intake conduits 50 of the respective combustion chambers, and is flown into the respective combustion chambers via the intake ports 23. A throttle valve 52 is located in each intake conduit 50 upstream the serve tank 54. The opening of the throttle valve 52 is regulated by an electric actuator 53 to control the quantity of the air flown into the combustion chamber. Each combustion chamber has two fuel injection valves 26 and 55. The fuel injection valve 26 located in the cylinder head 20 gives a direct spray of the fuel into the combustion chamber, whereas the fuel injection valve 55 located in the intake conduit 50 gives a spray of the fuel in the intake conduit 50 toward the intake port 23. The supply of the fuel injected from the fuel injection valve 26 or from the fuel injection valve 55 is vaporized to form a mixture of the fuel and the air (air-fuel mixture) in each combustion chamber.

Each exhaust conduit 58 is connected with the exhaust port 24 of each combustion chamber to lead and release the exhaust gas discharged from the combustion chamber to the outside. The EGR conduit 70 connects the exhaust conduit 58 with the intake conduit 50. Part of the exhaust gas flowing through the exhaust conduit 58 is recirculated to the intake conduit 50 via the EGR conduit 70 and is fed with the intake air into the combustion chamber. An EGR valve 72 is located in the middle of the EGR conduit 70. The opening of the EGR valve 72 is regulated to control the flow of the exhaust gas recirculation (EGR gas).

The ECU 60 is constructed by a microcomputer including a central processing unit (CPU), a ROM, a RAM, and an input/output circuit, which are mutually connected via a bus. The ECU 60 receives required information from a crank angle sensor 61 attached to the crankshaft 43 and an accelerator opening sensor 62 built in an accelerator pedal, and controls actuation of the fuel injection valves 26 and 55 and the ignition plug 27 at adequate timings to make the air-fuel mixture subjected to combustion in the combustion chambers and generate the power. The ECU 60 also controls actuation of the electric actuator 53 to regulate the flow of intake air and actuation of the actuator 33 to vary the compression ratio. The CU 60 detects a warm-up state of the engine 10, based on an output of a water temperature sensor 64 located in the upper block 31.

In the engine 10 having the configuration discussed above, some trouble or failure may arise in the actuator 33 or in another component of the compression ratio varying mechanism to lock in the current compression ratio. One example of such trouble is locking of the actuator 33 to lock in the current low setting of the compression ratio or to prevent the compression ratio from being set to a higher level while allowing the compression ratio to be varied only in a low range. As described previously, the low compression ratio is disadvantageous to stable combustion. The occurrence of such failure worsens the combustion conditions and may lead to an unstable drive of the engine 10. The engine 10 of the embodiment has a control strategy as discussed below to ensure a stable drive of the engine 10, even when some trouble or failure arises in the compression ratio varying mechanism.

B. First Embodiment

Figure 2:
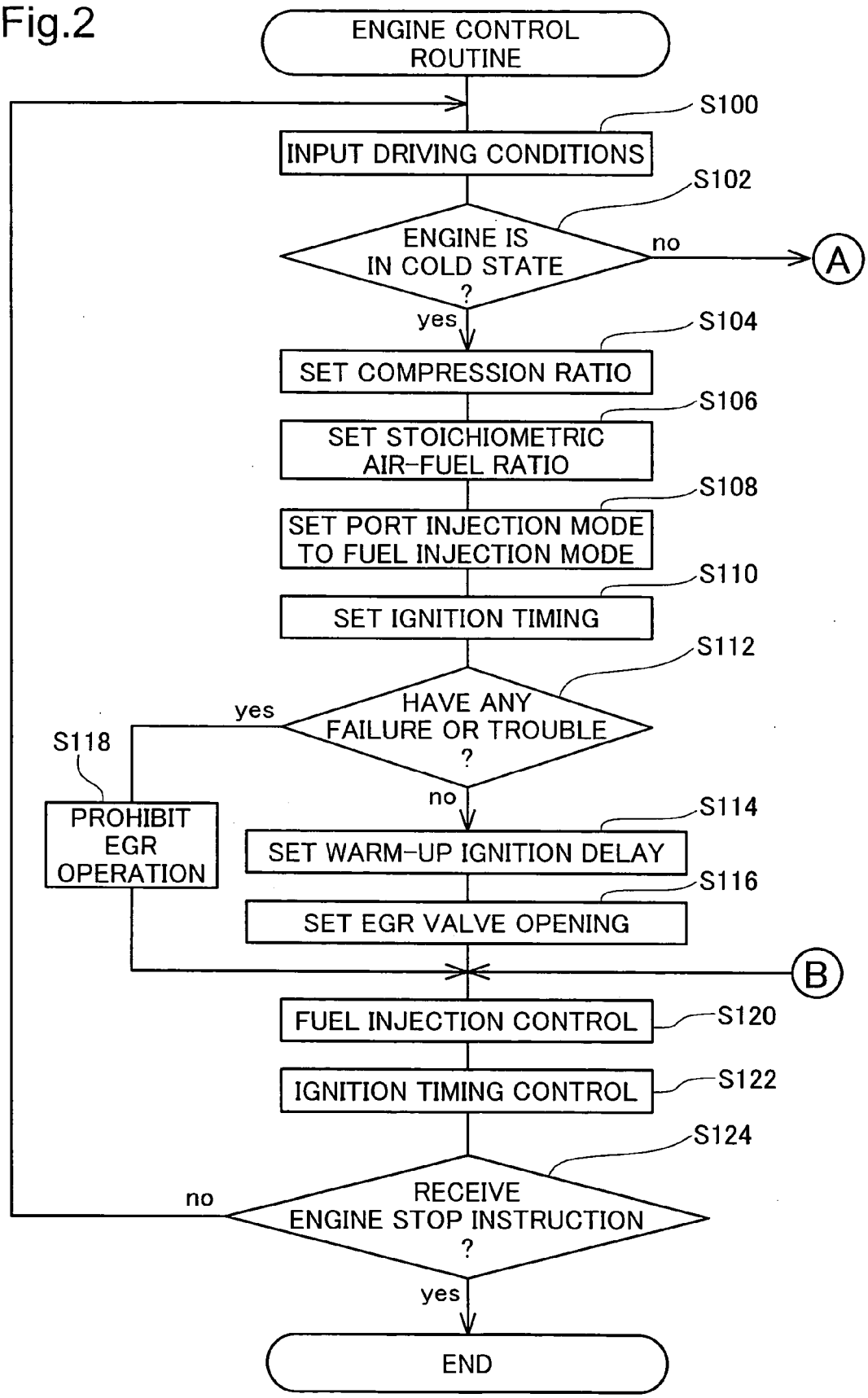
FIG. 2 is a flowchart showing a control flow in a cold state in an engine control routine of a first embodiment.
Figure 3:
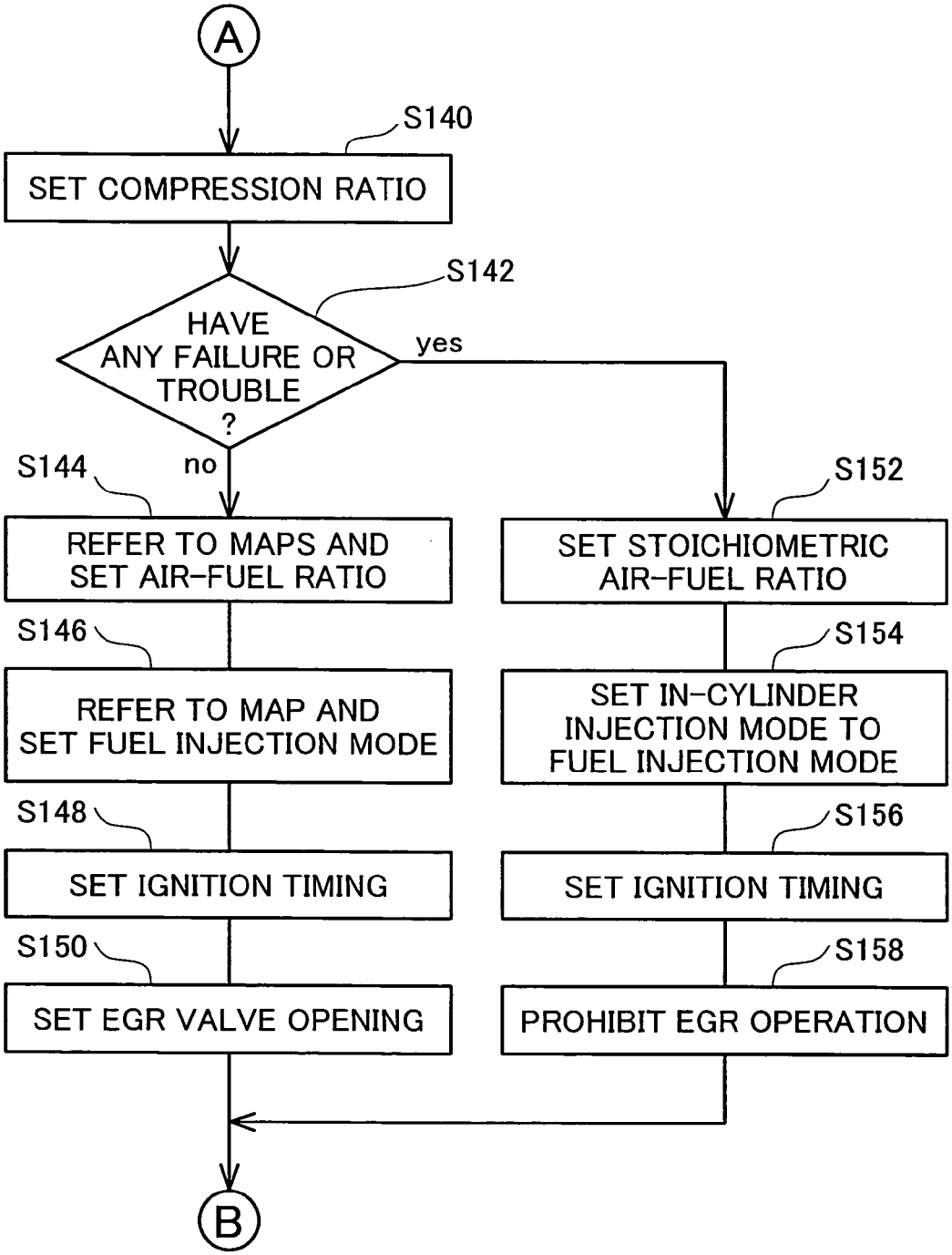
FIG. 3 is a flowchart showing a control flow in a warm-up state in the engine control routine of the first embodiment.

An engine control routine for controlling the operations of the engine 10 in a first embodiment is discussed below with reference to the flowcharts of FIGS. 2 and 3.

When the engine control routine starts, the ECU 60 first receives inputs of driving conditions of the engine 10 (step S100). The driving conditions input here are a revolution speed of the engine 10 or an engine speed Ne and an accelerator opening qac. The engine speed Ne is computed from the output of the crank angle sensor 61, and the accelerator opening qac is measured by the accelerator opening sensor 62.

The ECU 60 subsequently determines whether the engine 10 is in a cold state (step S102). The ECU 60 specifies the temperature of cooling water in the upper block 31, based on the output of the water temperature sensor 64. It is determined that the engine 10 is in the cold state (step S102: yes), when the specified temperature of cooling water is not higher than a preset level. It is determined that the engine 10 is not in the cold state (step S102: no), on the other hand, when the specified temperature of cooling water is higher than the preset level. The control of the engine 10 in the cold state is different from the control of the engine 10 in the non-cold state (that is, in a warm-up state). The description first regards the control flow in the cold state and then the control flow in the warm-up state.

B-1. Control in Cold State

Figure 4:
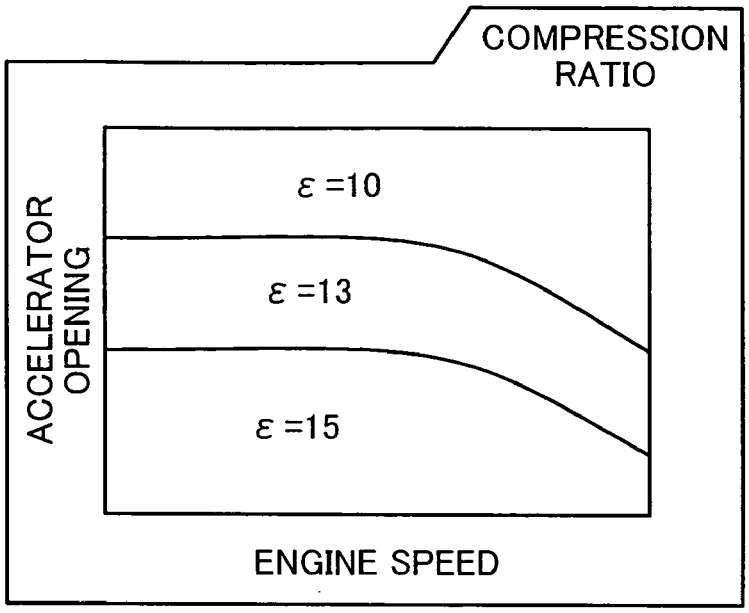
FIG. 4 conceptually shows a map of adequate settings of the compression ratio against the driving conditions.

When it is determined that the engine 10 is in the cold state (step S102: yes), the ECU 60 sets a compression ratio of the engine 10, based on the input driving conditions (step S104). The adequate settings of the compression ratio against the driving conditions, the engine speed Ne and the accelerator opening qac, as parameters are stored in the form of a map in the ROM of the ECU 60. FIG. 4 conceptually shows a map of adequate settings of the compression ratio against the driving conditions, which is stored in the ROM. A similar map of adequate settings of the compression ratio in the warm-up state, as well as the map in the cold state shown in FIG. 4, is stored in the ROM of the ECU 60. The engine in the cold state has the higher potential for unstable combustion of the air-fuel mixture. In order to ensure stable combustion, the settings of the compression ratio in the map in the cold state are higher than those in the map in the warm-up state. The ECU 60 refers to this map, reads the setting of the compression ratio corresponding to the input driving conditions, and actuates the actuator 33 to set the compression ratio in the engine 10 at step S104.

After setting the compression ratio, the ECU 60 sets an air-fuel ratio (step S106). The air-fuel ratio is an indicator representing a concentration of the fuel in the air-fuel mixture and is calculated by dividing the weight of the air included in the air-fuel mixture by the weight of the fuel. The procedure of this embodiment sets a stoichiometric air-fuel ratio, regardless of the driving conditions, when the engine 10 is in the cold state. At the stoichiometric air-fuel ratio, the air and the fuel are mixed to attain just sufficient combustion. When the engine 10 is in the cold state, the stoichiometric air-fuel ratio is set to ensure stable combustion of the air-fuel mixture. The air-fuel ratio having a lower concentration of the fuel than that of the stoichiometric air-fuel ratio is called the lean air-fuel ratio. The air-fuel ratio having a higher concentration of the fuel than that of the stoichiometric air-fuel ratio is called the rich air-fuel ratio.

After setting the air-fuel ratio, the ECU 60 sets a fuel injection mode (step S108). As shown in FIG. 1, the engine 10 of the embodiment has the two fuel injection valves 26 and 55. Actuation of the fuel injection valve 26 set in the cylinder head 20 gives a direct spray of the fuel into the combustion chamber. The fuel is accordingly localized in the combustion chamber to form a section of the higher fuel concentration (that is, the lower air-fuel ratio) and a section of the lower fuel concentration (that is, the higher air-fuel ratio). The air-fuel mixture having an adequate distribution of the air-fuel ratio in the combustion chamber desirably saves the total quantity of the fuel and enhances the thermal efficiency of the engine 10. The mode of directly injecting the fuel into the combustion chamber is called the in-cylinder injection mode.

Actuation of the fuel injection valve 55 set in the intake conduit 50, on the other hand, gives an injection of the fuel in the intake conduit 50. The injected fuel is vaporized, is mixed with the air, and is taken into the combustion chamber. In this case, the fuel and the air are well blended to form the homogeneous air-fuel mixture in the combustion chamber. The homogeneous air-fuel mixture set to have the stoichiometric air-fuel ratio ensures the most stable combustion. The homogeneous air-fuel mixture set to have the lower air-fuel ratio than the stoichiometric air-fuel ratio (that is, the higher fuel concentration), on the other hand, enables output of the maximum power. The mode of injecting the fuel in the intake conduit 50 is called the port injection mode.

The in-cylinder injection may be adopted in combination with the port injection. Such combination makes part of the fuel injected in the intake conduit 50 and the residual fuel directly injected into the combustion chamber. The air-fuel mixture having the high fuel concentration is localized in a partial area of the combustion chamber, while the homogeneous air-fuel mixture having the lower fuel concentration is present in the other area of the combustion chamber. The injection amounts and the injection timings of these two fuel injection valves 26 and 55 are regulated according to the driving conditions to form the air-fuel mixture having an appropriate distribution of the air-fuel ratio in the combustion chamber. This exploits the high performance of the engine 10.

Since the engine 10 is in the cold state, the ECU 60 selects the port injection mode for the fuel injection to ensure stable combustion of the air-fuel mixture at step S108. The stoichiometric air-fuel ratio has been set at step S106. The homogeneous air-fuel mixture having the stoichiometric air-fuel ratio is accordingly formed in the combustion chamber to ensure ]]]]]]]stable combustion of the air-fuel mixture, while the engine 10 is in the cold state.

Figure 5:
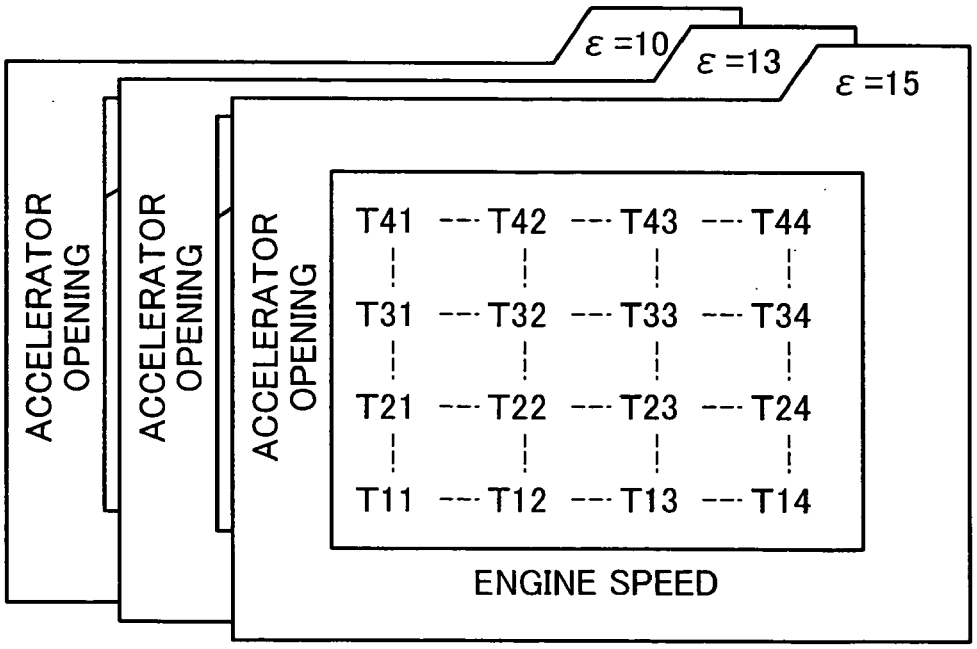
FIG. 5 conceptually shows maps of adequate settings of the ignition timing against the driving conditions with respect to various settings of the compression ratio.

The ECU 60 subsequently sets an ignition timing (step S110) The ignition timing is set by referring to a map, as in the case of the compression ratio. Adequate settings of the ignition timing against the driving conditions, the engine speed Ne and the accelerator opening qac, as parameters with respect to various settings of the compression ratio are stored in the form of maps in the ROM of the ECU 60. FIG. 5 conceptually shows maps of adequate settings of the ignition timing against the driving conditions with respect to various settings of the compression ratio. The ECU 60 refers to a map for the current compression ratio set at step S104 and sets the ignition timing corresponding to the input driving conditions at step S110.

After setting the ignition timing, the ECU 60 determines whether the compression ratio varying mechanism has any failure or trouble (step S112). As described above, the upper block 31 of the engine 10 is vertically moved relative to the lower block 32 to vary the compression ratio in the engine 10. Namely the relative position of the upper block 31 to the lower block 32 immediately specifies the compression ratio actually set in the engine 10. The actual compression ratio of the engine 10 is accordingly specified, based on the relative position of the upper block 31 detected by the compression ratio sensor 63 located in the lower block 32. When the observedl compression ratio is identical with the compression ratio set at step S104 in the engine control routine, the ECU 60 determines that the compression ratio varying mechanism functions normally. When the specified compression ratio is different from the setting of the compression ratio, on the other hand, the ECU 60 determines that the compression ratio varying mechanism has some failure or trouble.

Figure 6:
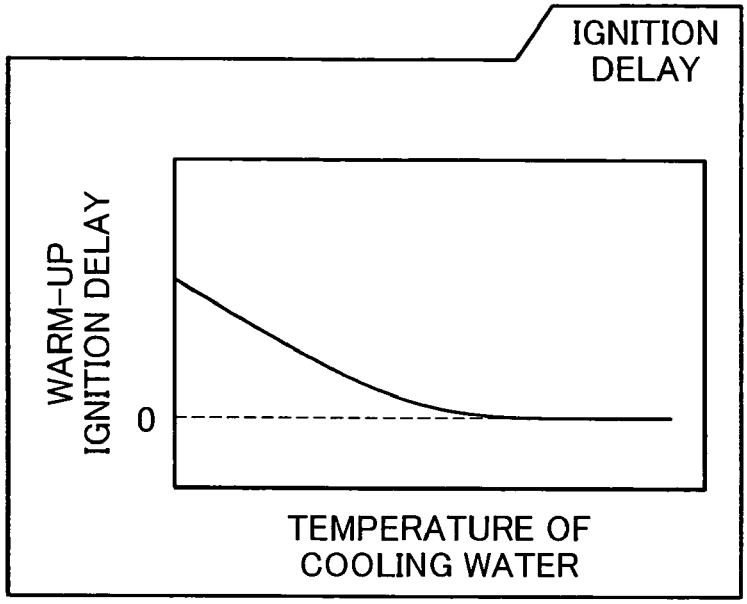
FIG. 6 conceptually shows a map of a variation in warm-up ignition delay against the temperature of cooling water.

When it is determined that there is no failure or trouble in the compression ratio varying mechanism (step S112: no), the ECU 60 sets a warm-up ignition delay (step S114). The warm-up ignition delay is an operation carried out when the engine 10 is driven in the cold state, and retards the ignition timing from the standard timing to quickly warm the engine 10 up. The delay of the ignition timing from the standard timing lowers the thermal efficiency of the engine, that is, the conversion rate of thermal energy generated by combustion into mechanical power, while increasing the energy released as heat with the exhaust gas. This quickly warms up the engine or the emission control catalyst. An extreme delay of the ignition timing, however, causes unstable combustion of the air-fuel mixture. The adequate ignition timing is thus to be set with a variation in temperature of the engine. In the structure of this embodiment, a variation in adequate ignition delay against the temperature of cooling water is experimentally determined in advance and is stored in the form of a map as shown in FIG. 6 in the ROM of the ECU 60. The ECU 60 receives the observed temperature of cooling water in the engine 10, which is measured by the water temperature sensor 64 located in the upper block 31, and refers to the map of FIG. 6 to set the adequate delay of the ignition timing at step S114 in the flowchart of FIG. 2.

Figure 7:
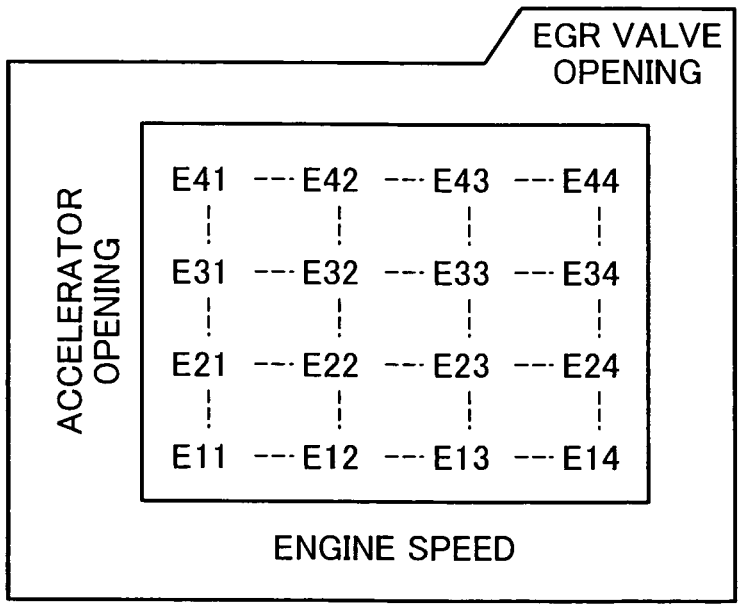
FIG. 7 conceptually shows a map of adequate settings of the EGR valve opening against the driving conditions.

After setting the warm-up ignition delay, the ECU 60 sets the opening of the EGR valve 72 (step S116). The EGR (exhaust gas recirculation) operation recirculates part of the exhaust gas to the combustion chamber for combustion with the air-fuel mixture. The EGR operation lowers the combustion temperature of the air-fuel mixture and thereby lowers the concentration of nitrogen oxides NOx included in the exhaust gas. The structure of this embodiment recirculates part of the exhaust gas from the exhaust conduit 58 to the intake conduit 50 via the EGR conduit 70 as the EGR operation as shown in FIG. 1. The flow of the exhaust gas recirculation (the flow of the EGR gas) is controlled by regulating the opening of the EGR valve 72 located in the EGR conduit 70. The optimum flow of the EGR gas, that is, the adequate EGR valve opening, depends upon the driving conditions of the engine. In the structure of this embodiment, adequate settings of the EGR valve opening against the driving conditions, that is, the engine speed Ne and the accelerator opening qac, as parameters in the cold state of the engine are determined in advance and are stored in the form of a map as shown in FIG. 7 in the ROM of the ECU 60. The ECU 60 refers to this map, reads the adequate setting of the EGR valve opening corresponding to the input driving conditions, and actually sets the opening of the EGR valve 72 at step S116.

On completion of the settings of the compression ratio, the air-fuel ratio, the fuel injection mode, the ignition timing, the warm-up ignition delay, and the EGR valve opening according to the driving conditions, the ECU 60 calculates the amount of fuel injection based on these settings and injects the fuel at an adequate timing (step S120), and ignites the air-fuel mixture with a spark from the ignition plug 27 in the combustion chamber at the adequate timing, which is determined by taking into account the warm-up ignition delay (step S122). This causes combustion of the air-fuel mixture in the combustion chamber and generates power.

When it is determined that the compression ratio varying mechanism has some failure or trouble (step S112: yes), the engine control routine skips the processing of step S114 to set the warm-up ignition delay and the processing of step S116 to set the EGR valve opening but prohibits the EGR operation (step S118), because of the reasons discussed below.

When the engine 10 is driven in the cold state, the warm-up ignition delay accelerates the warm-up of the engine 10. The warm-up ignition delay retards the ignition timing from the adequate ignition timing and thus adversely affects the stable combustion of the air-fuel mixture. The warm-up ignition delay is set in the range of ensuring stable combustion. But when any failure or trouble arises in the compression ratio varying mechanism, the warm-up ignition delay may lead to unstable combustion. For example, when the current low setting of the compression ratio is locked in, the combination of the lock-in of the low compression ratio with the adverse effects of the warm-up ignition delay may cause unstable combustion. The same problem is found when the compression ratio is not settable to a higher level but is variable only in a low range, for example, when the compression ratio is not settable to the high setting 15 but is selectable only between the lower settings 10 and 13.

Like the warm-up ignition delay, the EGR operation adversely affects the stable combustion. The exhaust gas remaining after combustion of the air-fuel mixture is basically an incombustible inert gas. The EGR operation leads the flow of this inert gas with the air-fuel mixture to the combustion chamber and accordingly has the adverse effects on the stable combustion. When any failure or trouble arises in the compression ratio varying mechanism, the EGR operation may lead to unstable combustion, because of the same reason discussed above with regard to the warm-up ignition delay.

Because of the reasons discussed above, the engine control routine of this embodiment skips the settings of the warm-up ignition delay and the EGR valve opening and prohibits the EGR operation at step S118, in the case of the occurrence of any failure or trouble in the compression ratio varying mechanism. The EGR operation is prohibited by setting the EGR valve 72 at its full closed position. In this case, the subsequent fuel injection control (step S120) and ignition timing control (step S122) are carried out without the warm-up ignition delay and the EGR operation. This ensures stable combustion of the air-fuel mixture in the combustion chamber, regardless of the setting of the compression ratio in the engine 10.

The ECU 60 determines whether the driver gives an engine stop instruction to stop the engine 10 (step S124). When it is determined that the driver gives an engine stop instruction (step S124: yes), the engine control routine shown in FIG. 2 is terminated. When it is determined that the driver gives no engine stop instruction (step S124: no), on the other hand, the engine control routine returns to step S100 and repeats the above series of processing. In the course of the processing, the temperature of cooling water in the engine 10 gradually rises and the engine 10 is set in the warm-up state. The engine control routine then proceeds to the control in the warm-up state as discussed below.

B-2. Control in Warm-up State

The following description regards the control executed when the engine 10 is in the warm-up state, that is, in the case of a negative answer at step S102. FIG. 3 is a flowchart showing a control flow executed when the engine 10 is in the warm-up state. When the control flow of FIG. 3 starts, the ECU 60 first sets the compression ratio (step S140). This is almost equivalent to the processing of step S104 in the flowchart of FIG. 2 to set the compression ratio in the cold state. The ECU 60 refers to the map of the adequate settings of the compression ratio in the warm-up state, which is stored in the ROM of the ECU 60, reads the setting of the compression ratio corresponding to the input driving conditions, and actuates the actuator 33 to set the compression ratio in the engine 10 at step S140. As mentioned previously, the settings of the compression ratio in the map to be referred to in the warm-up state are lower than those in the map of FIG. 4 to be referred to in the cold state.

The ECU 60 subsequently determines whether any failure or trouble arises in the compression ratio varying mechanism (step S142). As described above, the procedure of detecting the occurrence of a failure or trouble compares the actual compression ratio measured by the compression ratio sensor 63 with the compression ratio set corresponding to the driving conditions at step S140. When the observed compression ratio is identical with the setting of the compression ratio, it is determined that the compression ratio varying mechanism has no failure or trouble (step S142: no). When the observed compression ratio is different from the setting of the compression ratio, on the other hand, it is determined that the compression ratio varying mechanism has some failure or trouble (step S142: yes).

Figure 8:
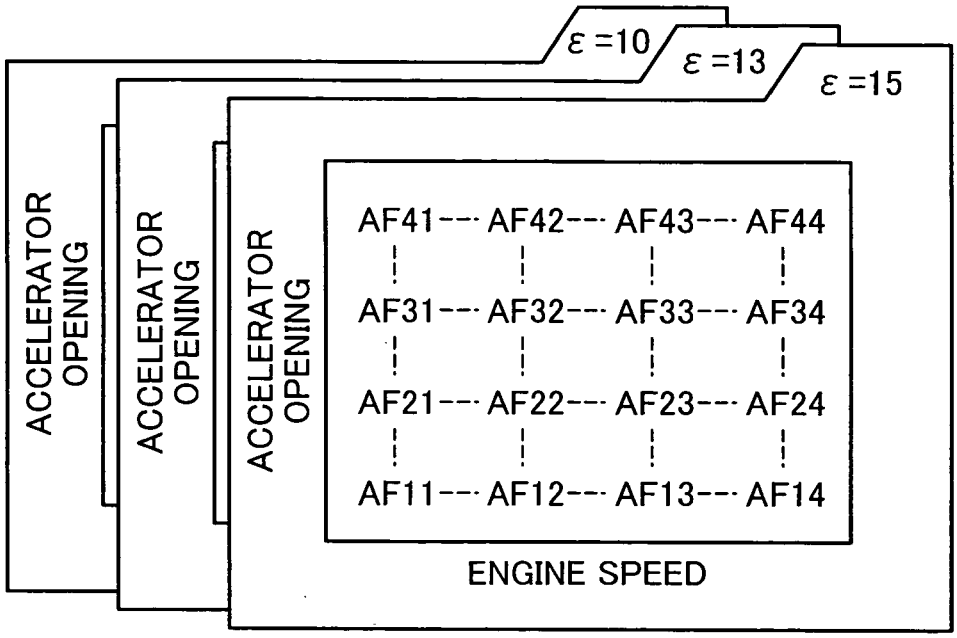
FIG. 8 conceptually shows maps of adequate settings of the air-fuel ratio against the driving conditions with respect to various settings of the compression ratio.

In the case of a negative answer at step S142, that is, when it is determined that the compression ratio varying mechanism has no failure or trouble, the ECU 60 sets the air-fuel ratio (step S144). When the engine 10 is in the cold state, the stoichiometric air-fuel ratio is set at step S106 in the flowchart of FIG. 2. When the engine 10 is in the warm-up state, on the other hand, an adequate air-fuel ratio is set according to the driving conditions. Adequate settings of the air-fuel ratio against the driving conditions, the engine speed Ne and the accelerator opening qac, as parameters with respect to various settings of the compression ratio are determined in advance and are stored in the form of maps in the ROM of the ECU 60. FIG. 8 conceptually shows maps of adequate settings of the air-fuel ratio against the driving conditions with respect to various settings of the compression ratio, which are stored in the ROM. The ECU 60 refers to a map for the current setting of the compression ratio and sets the adequate air-fuel ratio corresponding to the input driving conditions at step S144.

After setting the air-fuel ratio, the ECU 60 sets the fuel injection mode (step S146). As described previously with reference to FIG. 1, the engine 10 of the embodiment has the two fuel injection valves 26 and 55 to directly inject the supply of fuel into the combustion chamber (the in-cylinder injection mode) and to inject the supply of fuel in the intake conduit 50 (the port injection mode), prior to the flow-in of the air and the injected fuel to the combustion chamber. In the in-cylinder injection mode, the fuel injection timing is adequately set to form a high fuel concentration area and a low fuel concentration area in the combustion chamber. For example, the fuel injection control is executed to form a high fuel concentration area in the vicinity of the ignition plug 27 and a low fuel concentration area in the residual part of the combustion chamber. Such control assures stable combustion of the air-fuel mixture having the lean air-fuel ratio. In the port injection mode, the fuel is injected in the intake conduit 50 and is flown together with the air into the combustion chamber. This well mixes the fuel with the air and forms the homogeneous air-fuel mixture in the combustion chamber. The port injection mode is thus advantageous to quick combustion of the air-fuel mixture to generate a large power. The engine 10 of the embodiment takes advantage of the two fuel injection valves 26 and 55 and selectively sets the in-cylinder injection mode or the port injection mode to the fuel injection mode. The ECU 60 sets the adequate fuel injection mode according to the input driving conditions at step S146.

Figure 9:
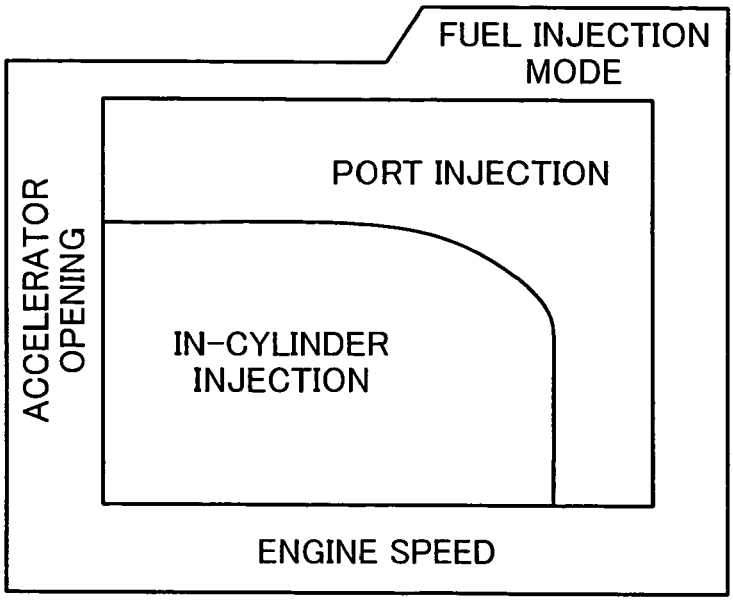
FIG. 9 conceptually shows a map of adequate settings of the fuel injection mode against the driving conditions.

FIG. 9 conceptually shows a map of the fuel injection mode against the driving conditions, which is stored in the ROM of the ECU 60. As illustrated in this map, the port injection mode is selected as the fuel injection mode under the driving conditions of the high engine speed Ne and/or the large accelerator opening qac that require the large power output. The in-cylinder injection mode is selected as the fuel injection mode in the other driving conditions. The ECU 60 refers to this map and selects the adequate fuel injection mode according to the driving conditions at step S146.

After setting the air-fuel ratio and the fuel injection mode, the ECU 60 sets the ignition timing and the EGR valve opening (steps S148 and S150). The processing of these steps is substantially identical with the settings in the cold state discussed above (see steps S110 and S116 in the flowchart of FIG. 2). Maps of adequate settings of the ignition timing in the warm-up state similar to those of FIG. 5 and a map of adequate settings of the EGR valve opening in the warm-up state similar to that of FIG. 7 are stored in the ROM of the ECU 60. The ECU 60 refers to the maps of the adequate settings of the ignition timing in the warm-up state to set the ignition timing at step S148, and refers to the map of the adequate settings of the EGR valve opening in the warm-up state to set the EGR valve opening at step S150. When it is determined that the engine 10 is in the warm-up state and that the compression ratio varying mechanism has no failure or trouble, the ECU 60 carries out the fuel injection control (step S120 in the flowchart of FIG. 2) and the ignition timing control (step S122) with the settings of the air-fuel ratio, the fuel injection mode, and the ignition timing to adequately drive the engine 10.

When it is determined that the compression ratio varying mechanism has any trouble or failure (step S142: yes), on the other hand, the ECU 60 sets the stoichiometric air-fuel ratio (step S152). Setting the stoichiometric air-fuel ratio ensures stable combustion of the air-fuel mixture, regardless of the setting of the compression ratio, as described previously. The ECU 60 subsequently sets the in-cylinder injection mode to the fuel injection mode (step S154), in order to prevent the occurrence of backfire. In general, the air-fuel mixture quickly combusts to heighten the inner pressure of the combustion chamber, press the piston 41 down, and generate power. The lock-in of the compression ratio at the low level, however, may lead to the slow and poor combustion of the air-fuel mixture even during the downward movement of the piston 41. A further extension of the slow combustion to the subsequent intake cycle may cause a backflow of the hot exhaust from the combustion chamber into the intake conduit 50 via the intake valve 21 and combust the fuel present in the intake conduit 50. This phenomenon is called backfire.

The backfire is typically observed when the engine is driven at the rich air-fuel ratio. The backfire is the phenomenon occurring when the combustion of the air-fuel mixture continues even during the downward movement of the piston 41. In the case of the lean air-fuel ratio of the air-fuel mixture, the combustion often dies out during the downward movement of the piston 41. This does not cause the backfire. The control flow of this embodiment sets the stoichiometric air-fuel ratio at step S152 to ensure the stable combustion of the air-fuel mixture. This is the backfire-susceptible condition. The backfire makes a dreadful noise to astonish the driver and may even damage the serve tank 54. The processing of step S154 sets the in-cylinder injection mode to the fuel injection mode by taking into account the potential for the backfire. In the in-cylinder injection mode, the fuel is not present in the intake conduit 50. This perfectly precludes the possibility of the backfire.

The ECU 60 then refers to the maps of the adequate settings of the ignition timing stored in the ROM of the ECU 60 and sets the ignition timing (step S156). Here the control flow may use the maps of the adequate settings of the ignition timing in the cold state shown in FIG. 5 to set the ignition timing. As described above, the control flow in the cold state carries out the warm-up ignition delay to retard the ignition timing from the adequate setting of the ignition timing. The control flow in the warm-up state, however, does not carry out the warm-up ignition delay and sets the practically adequate ignition timing based on the maps of FIG. 5. Another applicable procedure may store maps of adequate settings of the ignition timing for the stoichiometric air-fuel ratio in the warm-up state in the ROM of the ECU 60 and refer to these maps to set the ignition timing.

After setting the ignition timing, the ECU 60 prohibits the EGR operation (step S158). The EGR operation adversely affects the stable combustion of the air-fuel mixture, as described previously. The processing of step S158 thus sets the EGR valve 72 at its full closed position and prohibits the EGR operation to ensure stable combustion of the air-fuel mixture.

The ECU 60 carries out the fuel injection control (step S120) and the ignition timing control (step S122) with the settings of the air-fuel ratio, the fuel injection mode, and the ignition timing. When the compression ratio varying mechanism has any failure or trouble, the control flow prohibits the EGR operation and forms the air-fuel mixture having the stoichiometric air-fuel ratio, which is stably combusted in the combustion chamber. Direct injection of the fuel into the combustion chamber eliminates the possibility of the backfire.

The ECU 60 then determines whether the driver gives an engine stop instruction to stop the engine 10 (step S124). When it is determined that the driver gives no engine stop instruction (step S124: no), the engine control routine returns to step S100 and repeats the above series of processing. When it is determined that the driver gives an engine stop instruction (step S124: yes), on the other hand, the engine control routine shown in FIG. 2 is terminated.

As described above, when the compression ratio varying mechanism has some failure or trouble, the control procedure of the first embodiment avoids the operations having adverse effects on stable combustion of the air-fuel mixture, that is, setting of the lean air-fuel ratio, delay of the ignition timing, and the EGR operation. One possible modification may avoid such operations having adverse effects on stable combustion of the air-fuel mixture, only when the compression ratio is locked in at the low level or when the compression ratio is not settable to a higher level. This modified procedure does not avoid these operations, when there is no possibility of poor combustion, as in the case of a lock-in of the compression ratio at the high level.

C. Second Embodiment

The procedure of the first embodiment skips the operations having adverse effects on the stable combustion of the air-fuel mixture, when any failure or trouble arises in the compression ratio varying mechanism. Another applicable procedure may restrict these operations to an allowable range corresponding to the observed compression ratio, in the case of the occurrence of a failure or trouble. This is described below as a second embodiment.

Figure 10:
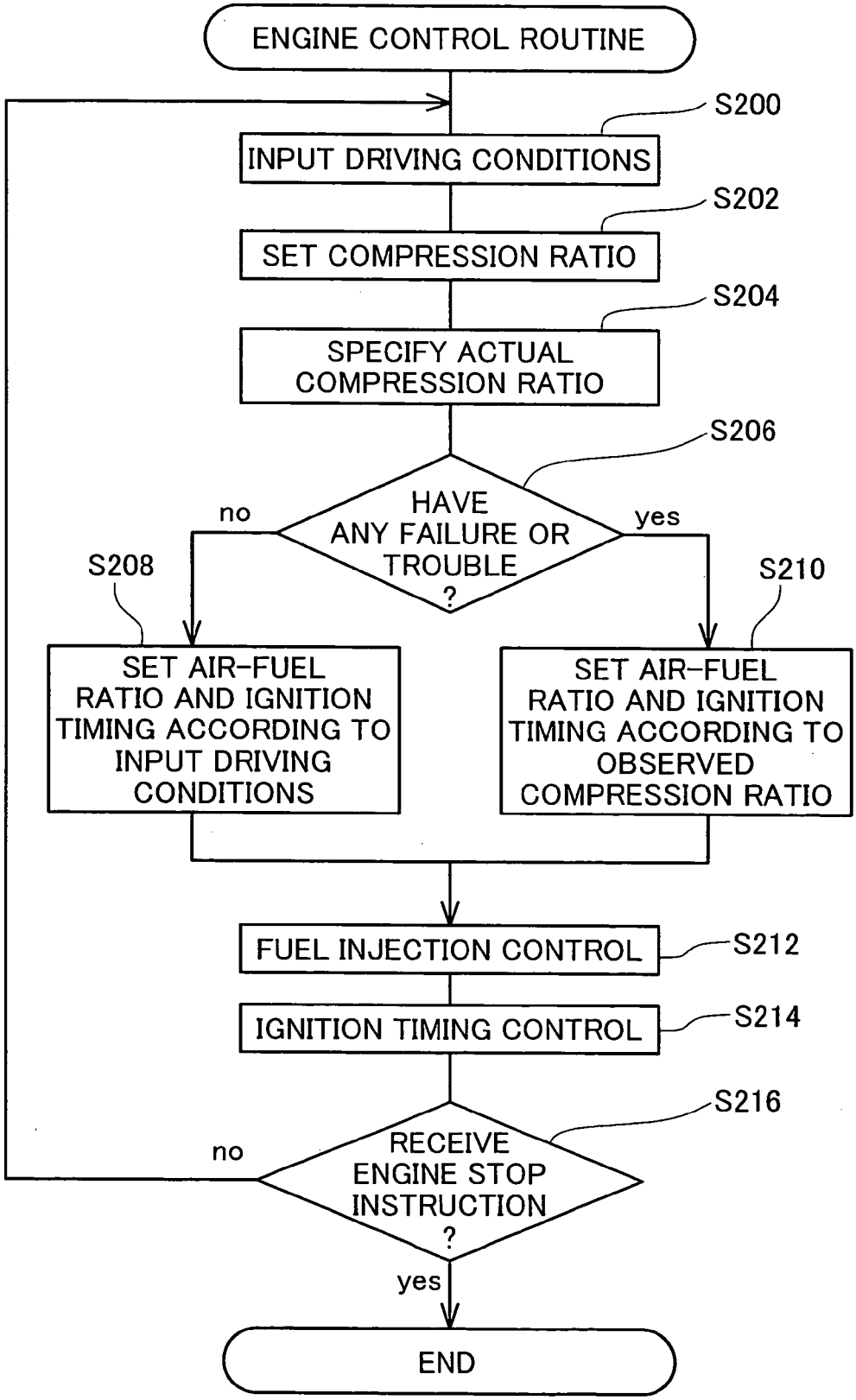
FIG. 10 is a flowchart showing an engine control routine executed in a second embodiment.

FIG. 10 is a flowchart showing an engine control routine executed in the second embodiment.

When the engine control routine of the second embodiment starts, the ECU 60 first receives inputs of driving conditions of the engine 10 (step S200). The driving conditions input here are the engine speed Ne and the accelerator opening qac.

The ECU 60 sets the compression ratio in the engine 10 (step S202). The compression ratio is set by referring to the map of the adequate settings of the compression ratio against the driving conditions (see FIG. 4), which is stored in the ROM of the ECU 60, like the first embodiment. The ECU 60 subsequently specifies the actual compression ratio set in the engine 10, based on the output of the compression sensor 63 (step S204), and compares the observed compression ratio with the setting of the compression ratio to detect the occurrence of any failure or trouble (step S206). When the observed compression ratio is identical with the setting of the compression ratio, it is determined that the compression ratio varying mechanism has no failure or trouble (step S206: no). The ECU 60 then sets the air-fuel ratio and the ignition timing according to the driving conditions (step S208). Like the first embodiment, the maps of the adequate settings of the air-fuel ratio against the driving conditions as parameters (see FIG. 8) and the maps of the adequate settings of the ignition timing against the driving conditions (see FIG. 5) are prepared in advance and are stored in the ROM of the ECU 60. The processing of step S208 refers to these maps and sets the adequate air-fuel ratio and ignition timing according to the input driving conditions and the compression ratio.

The ECU 60 calculates the amount of fuel injection based on the setting of the air-fuel ratio and actuates the fuel injection valve 26 at the adequate timing (step S212). This forms the air-fuel mixture having the preset air-fuel ratio in the combustion chamber. The ECU 60 then actuates the ignition plug 27 at the ignition timing set at step S208 to ignite the air-fuel mixture (step S214). This causes quick combustion of the air-fuel mixture in the combustion chamber and generates power.

When the observed compression ratio is different from the setting of the compression ratio, on the other hand, it is determined that the compression ratio varying mechanism has some failure or trouble (step S206: yes). In this case, the ECU 60 sets the air-fuel ratio and the ignition timing according to the observed compression ratio (step S210). The maps of the adequate settings of the air-fuel ratio with respect to various settings of the compression ratio as shown in FIG. 8 are prepared in advance and are stored in the ROM of the ECU 60. The maps of the adequate settings of the ignition timing with respect to various settings of the compression ratio as shown in FIG. 5 are also stored in the ROM of the ECU 60. The processing of step S210 refers to the maps for the observed compression ratio and sets the air-fuel ratio and the ignition timing. For example, when the observed compression ratio is e=10 and the compression ratio set at step S202 is e=15, the ECU 60 refers to the maps for the compression ratio e=10 to set the air-fuel ratio and the ignition timing. When the observed compression ratio is e=11, the ECU 60 interpolates the maps for the compression ratio e=10 and those for the compression ratio e=13 and computes the air-fuel ratio and the ignition timing corresponding to the compression ratio e=11.

After the setting of the air-fuel ratio and the ignition timing according to the observed compression ratio, the ECU 60 carries out the fuel injection control (step S212) and the ignition timing control (step S214). When the compression ratio varying mechanism has any failure or trouble, the control flow of the second embodiment specifies the compression ratio actually set in the engine 10 and sets the air-fuel ratio and the ignition timing in an allowable range corresponding to the observed compression ratio. This arrangement ensures stable operations of the engine 10 without worsening the combustion state of the air-fuel mixture, even when some failure or trouble arises in the compression ratio varying mechanism.

The control routine of the second embodiment does not include the EGR control and the warm-up ignition delay control. Such omission is only for the purpose of clarification of explanation. The control routine of the second embodiment may thus include the EGR control and the warm-up ignition delay control according to the requirements, like the first embodiment.

The embodiments discussed above are to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

The scope and spirit of the present invention are indicated by the appended claims, rather than by the foregoing description.

What is claimed is:

1. An internal combustion engine that compresses an air-fuel mixture of a fuel and the air and makes the compressed air-fuel mixture subjected to combustion in a combustion chamber to generate power, said internal combustion engine comprising:

a compression ratio varying mechanism that varies a compression ratio as an indicator representing a degree of compression of the air-fuel mixture;

a compression ratio control module that controls actuation of said compression ratio varying mechanism, so as to regulate the compression ratio according to a driving condition of said internal combustion engine;

a failure detection module that detects occurrence of a failure in said compression ratio varying mechanism; and a specific control restriction module that, in response to detection of the occurrence of a failure, maintains a current compression ratio and restricts execution of a specific control that has adverse effects on stable combustion of the air-fuel mixture.

2. An internal combustion engine in accordance with claim 1, wherein said compression ratio varying mechanism has a mechanism that changes over the compression ratio between at least two different levels, that is, a first compression ratio of a lowest level and a second compression ratio of a highest level, and said failure detection module detects a non-variable state of the compression ratio to at least the second compression ratio in said compression ratio varying mechanism.

3. An internal combustion engine in accordance with claim 2, wherein said failure detection module detects a lock-in of said compression ratio varying mechanism at a compression ratio different from the second compression ratio.

4. An internal combustion engine in accordance with claim 1, said internal combustion engine further comprising:

an air-fuel ratio control module that sets an air-fuel ratio, which is an indicator representing a ratio of the air to the fuel included in the air-fuel mixture, equal to at least either of a stoichiometric air-fuel ratio, which ensures just sufficient combustion of the air and the fuel, and a lean air-fuel ratio, which has insufficiency of the fuel to the air, according to the driving condition of said internal combustion engine, wherein said specific control restriction module, in response to detection of the occurrence of a failure, restricts the control of setting the lean air-fuel ratio to the air-fuel ratio of the air-fuel mixture.

5. An internal combustion engine in accordance with claim 1, said internal combustion engine further comprising:

an ignition module that emits a spark at a preset timing in the combustion chamber to start combustion of the compressed air-fuel mixture;

a cold state detection module that detects that said internal combustion engine is in a cold state; and a cold-state ignition delay control module that, when said internal combustion engine is in the cold state, controls said ignition module and carries out an ignition delay control to retard a timing of emitting the spark from the preset timing, wherein said specific control restriction module restricts execution of the ignition delay control, in response to detection of the occurrence of a failure.

6. An internal combustion engine in accordance with claim 1, said internal combustion engine further comprising:

an EGR mechanism that recirculates part of a combustion exhaust, which is produced by combustion of the air-fuel mixture, to the combustion chamber; and an EGR control module that controls the amount of the recirculated combustion exhaust by operating said EGR mechanism according to the driving condition of said internal combustion engine, wherein said specific control restriction module restricts the recirculation by said EGR mechanism, in response to detection of the occurrence of a failure.

7. An internal combustion engine in accordance with claim 1, wherein said failure detection module detects a lock-in of said compression ratio varying mechanism, and said specific control restriction module comprises an allowable control specification storage module that stores an allowable control specification of the specific control corresponding to each lock-in compression ratio, at which said compression ratio varying mechanism is locked in, said specific control restriction module restricts execution of the specific control to the allowable control specification corresponding to the lock-in compression ratio.

8. An internal combustion engine in accordance with claim 1, said internal combustion engine further comprising:

an intake conduit that leads a supply of intake air to the combustion chamber;

a first fuel injection valve that injects the fuel in the intake conduit;

a second fuel injection valve that injects the fuel into the combustion chamber; and a fuel injection control module that actuates at least one of the first fuel injection valve and the second fuel injection valve to inject the fuel according to the driving condition of said internal combustion engine, wherein said specific control restriction module restricts actuation of the first fuel injection valve to inject the fuel, in response to detection of the occurrence of a failure.

9. A control method of an internal combustion engine that compresses an air-fuel mixture of a fuel and the air and makes the compressed air-fuel mixture subjected to combustion in a combustion chamber to generate power, said control method comprising the steps of:

controlling actuation of a compression ratio varying mechanism, which varies a compression ratio as an indicator representing a degree of compression of the air-fuel mixture, according to a driving condition of said internal combustion engine, so as to regulate the compression ratio of said internal combustion engine;

detecting occurrence of a failure in said compression ratio varying mechanism; and maintaining a current compression ratio and restricting execution of a specific control that has adverse effects on stable combustion of the air-fuel mixture, in response to detection of the occurrence of a failure.

* * * * *